United States Patent [19]

Yoshimura et al.

[11] Patent Number: 4,871,476

[45] Date of Patent: Oct. 3, 1989

[54] SYNTHETIC LUBRICATING FLUID

[75] Inventors: Narihiko Yoshimura; Michihide Tokashiki; Tetsuo Ishii, all of Saitama, Japan

[73] Assignee: Toa Nenryo Kogyo K.K., Tokyo, Japan

[21] Appl. No.: 80,004

[22] Filed: Jul. 31, 1987

[51] Int. Cl.[4] ..... C10M 105/34; C10M 107/02

[52] U.S. Cl. ..... 252/565

[58] Field of Search ..... 252/565

[56] References Cited

U.S. PATENT DOCUMENTS

| | | | |
|---|---|---|---|
| 2,016,392 | 10/1935 | Schneider | 260/99.40 |
| 2,807,638 | 9/1957 | Morris et al. | 260/468 |
| 3,133,021 | 5/1964 | Gisser | 252/565 |
| 3,383,405 | 5/1968 | Shiegoski | 252/565 |
| 3,440,894 | 4/1969 | Hammann | 252/565 |
| 3,595,797 | 7/1971 | Duling et al. | 252/73 |
| 3,871,837 | 6/1973 | Bedague et al. | 44/58 |
| 4,036,773 | 7/1977 | Okorodudu | 252/565 |
| 4,178,261 | 12/1979 | Dhein et al. | 252/57 |
| 4,292,187 | 9/1981 | Hentschel et al. | 252/565 |
| 4,343,652 | 8/1982 | Allart et al. | 106/21 |
| 4,464,277 | 8/1984 | Cousineau et al. | 252/565 |
| 4,499,000 | 2/1985 | Hentschel et al. | 252/73 |
| 4,514,190 | 4/1985 | Cousineau et al. | 44/70 |
| 4,519,932 | 5/1985 | Schnur et al. | 252/565 |
| 4,589,990 | 5/1986 | Zehler et al. | 252/565 |
| 4,606,833 | 8/1986 | Schuettenberg | 252/49.3 |

FOREIGN PATENT DOCUMENTS

| | | |
|---|---|---|
| 786950 | 11/1957 | United Kingdom . |
| 1593113 | 7/1981 | United Kingdom . |

OTHER PUBLICATIONS

Acylation of Glycerol, Ismailov, A. G., Salimova, 1971, No. 2, 49–54 (Russ.), From Ref. Zh., Khim, 1972, Abstr. No. 4Zh180.

Corina, D. et al., J. Chromatogr., 160 (1), 51–62, 1983.

*Primary Examiner*—William R. Dixon, Jr.

*Assistant Examiner*—Ellen McAvoy

*Attorney, Agent, or Firm*—M. B. Kapustij

[57] ABSTRACT

A synthetic lubricating fluid comprising:

(i) an ester or its derivative of cyclohexanol and cyclohexanecarboxylic acid represented by the formula

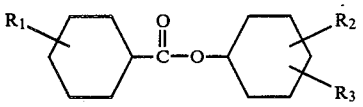

wherein $R_1$, $R_2$, and $R_3$ are independently selected from hydrogen and alkyl groups containing from 1 to 8 carbon atoms; and (ii) from 1 to 70% by weight of a branched poly-α-olefin.

3 Claims, No Drawings

SYNTHETIC LUBRICATING FLUID

FIELD OF THE INVENTION

This invention relates to a synthetic lubricating fluid comprising a mixture or blend of a synthetic naphthenic ester and a poly-α-olefin. This synthetic lubricating fluid is particularly suitable for use in power transmissions.

BACKGROUND OF THE INVENTION

Conventional lubricating fluids for power transmissions include a fluid comprised mainly of a mineral oil, a fluid comprised mainly of a naphthenic synthetic oil or poly-α-olefinic synthetic oil, and a fluid comprised of a mixture of two or more mineral oils or synthetic oils. Of these conventional lubricating fluids, the fluid comprised mainly of a naphthenic synthetic oil has been extensively studied because of its higher performance in power transmissions It is known that a hydrogenation product of α-alkylstyrene dimer exhibits the highest power transmission performance of all presently commercially available synthetic lubricating fluids. A representative example of such a synthetic lubricating fluid is "Santotrack" manufactured by the Monsanto Chemical Company and disclosed in, e.g., Japanese Patent Laid-Open No. 7664/1972. It has been suggested that the traction coefficient of a traction fluid can be increased if the fluid comprises a mixture of at least two components rather than a single component. Therefore, attempts have been made to prepare a synthetic fluid by mixing the above-mentioned hydrogenation product of α-alkylstyrene dimer or naphthenes, such as dimer, trimer or codimer which is produced from styrene, alkylstyrene or its derivatives, with paraffinic hydrocarbons. Such a lubricating fluid, is disclosed in Japanese Patent Publication No. 35763/1972.

However, the commercially available hydrogenation product of α-alkylstyrene dimer has the disadvantage in that the raw materials used for its production are rather expensive. Furthermore, the present trend in the industry is to develope smaller and more efficient power transmissions. In order to fully utilize the performance of newly developed power transmissions it is necessary to further improve the traction coefficient of the synthetic lubricating fluid used in these transmissions.

The term "traction coefficient" as used herein is defined as the ratio of the tractional force which is caused by slipping at the contact points between two rotating members which are in contact with each other in a power transmission of the rolling friction type to the normal load.

In recent years there has been progress in the development of continuously variable transmissions in the automobile industry. In such a transmission the higher the traction coefficient of the lubricating fluid the larger the force transmitted. This allows a reduction in size of the entire device with a corresponding reduction in the emission of polluting exhaust gas. Therefore, there is a strong demand for a lubricating fluid exhibiting the highest possible traction coefficient.

In general, it was believed that mixing at least two base oils could provide a fluid having a desired traction coefficient because of the additive effect discussed hereinafore. However, this additive effect does not exist with all base oils. For example, it is known that no additive improvement in performance is obtained when a naphthenic synthetic oil is blended with about 5 to 50% by weight of a viscosity index improver such as polymethacrylate.

In other words, the performance of power transmissions of automobiles or tractors can be remarkably enhanced if a synthetic lubricating fluid having a high traction coefficient is combined with another component which does not exhibit a high traction coefficient when used alone but exhibits a noticeable synergistic effect when used together with the fluid. However, such a synthetic lubricating fluid has not yet been developed.

The present inventors have made extensive and intensive studies with a view to developing a fluid having a high traction coefficient for use as a lubricating fluid in power transmissions. The present inventors have found that the addition of a specific amount of a branched poly-α-olefin to a synthetic naphthenic ester can meet the above-mentioned requirements. The present invention is based on this finding.

SUMMARY OF THE INVENTION

The instant invention is directed to a synthetic lubricating fluid for power transmissions comprising (i) an ester comprised of the reaction product of cyclohexanol and cyclohexanecarboxylic acid, and (ii) a branched poly-α-olefin.

DETAILED DESCRIPTION OF THE INVENTION

Specifically, in accordance with the present invention there is provided a synthetic lubricating fluid comprising an ester or its derivative of cyclohexanol with cyclohexanecarboxylic acid or its derivative (hereinafter often referred to as "component A") and a branched poly-α-olefin (hereinafter often referred to as "component B"). The fluid of the present invention is characterized in that the content of component B is 1 to 70% by weight based on the total weight of the fluid.

The ester of cyclohexanol and cyclohexanecarboxylic acid which constitutes component A is represented by the following general formula:

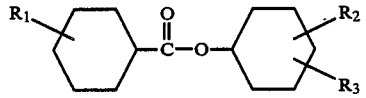

wherein $R_1$ $R_2$, and $R_3$ independently selected from a hydrogen atom or an alkyl group having 1 to 8 carbon atoms.

The above-mentioned ester can be produced by the following method. Cyclohexanecarboxylic acid or its derivative and cyclohexanol or its derivative are used as the reactants. The reaction is allowed to proceed using an excess amount of the alcohol in the presence of a catalyst such as phosphoric acid, while an inert gas such as nitrogen is blown into the reaction system.

The cyclohexanecarboxylic acid or its derivative reactant is a carboxylic acid having the above-mentioned general formula in which $R_1$ is a hydrogen atom or an alkyl group having 1 to 8 carbon atom. Examples of such carboxylic acid include cyclohexanecarboxylic acid, methylcyclohexanecarboxylic acid, ethylcyclohexanecarboxylic acid, propylcyclohexanecarboxylic acid, and isopropylclohexanecarboxylic acid. A particularly preferred carboxylic acid is cyclohexanecarboxylic acid. On the other hand, the cyclohexanol or its derivative reactant is a straight-chain or branched alkyl substituted cyclohexanol having the above-mentioned general formula in which $R_2$ and $R_3$ are each a hydrogen atom or an alkyl group having 1 to 8 carbon atoms.

Examples of the cyclohexanol include cyclohexanol, methylcyclohexanol, ethylcyclohexanol, propylcyclohexanol, isopropylcyclohexanol, and dimethylcyclohexanol, among which cyclohexanol is particularly preferred.

Phosphoric acid, p-toluenesulfonic acid, sulfuric acid or the like is used as the catalyst. The most preferred catalyst is phosphoric acid because it enhances the reaction rate and increases the yield of the ester.

In the esterification reaction the alcohol is used in an amount of 1.5 to 3 times, by mole, that of the acid. The amount of the catalyst is preferably 0.2 to 2% by weight based on the total amount of the alcohol and acid. The reaction temperature is 150° to 250° C., preferably 170° to 230° C., and the reaction time is 10 to 40 hr, preferably 15 to 25 hr. Water formed and evaporated during the esterification reaction is trapped so as not to return to the reaction vessel. The reaction is terminated when an equimolar amount, with respect to the acid, of the water has evaporated.

After completion of the reaction the reaction mixture is washed with an aqueous sodium hydroxide solution or the like until the reaction mixture is alkaline, and then washed with water until the reaction mixture is neutral. The reaction mixture is finally distilled under reduced pressure to remove the excess alcohol. When the pressure is 2 to 3 mmHg the alcohol distils at about 60° to 100° C.

The ester thus produced has a kinematic viscosity of 5 to 10 cst at 40° C. and has a traction coefficient about 5 to 7% higher than commercially available traction base oils having a viscosity in the same range. Therefore, the above-mentioned ester compares favorably with conventional commercially available fluids when it is used in a device which requires a high traction coefficient in a relatively low viscosity region such as textile producing machines and food processing machines.

However, the use of the ester constituting component A alone is unsatisfactory in applications where a higher traction coefficient is required in a higher viscosity region, e.g., automatic transmissions of automobiles and large machinery for civil engineering uses such as tractors. In such cases it is required that a branched poly-α-olefin, component B, be used in conjunction with component A.

The poly-α-olefin component B has quarternary carbon atom or a tertiary carbon atom in its main chain, and is a polymer of an α-olefin having 3 to 5 carbon atoms or the hydrogenation product thereof. Examples of the poly-α-olefin include polypropylene, polybutene, polyisobutylene and polypentene and the hydrogenation products thereof. Particularly preferred are polybutene and polyisobutylene and the hydrogenation products thereof. The polyisobutylene is represented by the following structural formula:

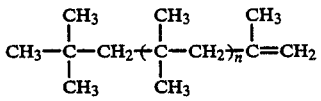

The hydrogenation product of the polyisobutylene is represented by the following structural formula:

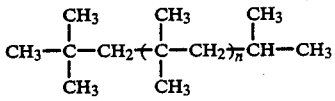

In the above-mentioned formulae, the degree of polymerization, n, is 6 to 200.

Although the polyisobutylene is generally commercially available, it may be produced by conventional polymerization methods. The hydrogenization product thereof is produced by reacting polyisobutylene in the presence of hydrogen. The molecular weight of the polyisobutylene and hydrogenization product thereof is preferably in the range of 500 to 10,000, more preferably in the range of 900 to 5,000. The molecular weight can be adjusted by suitable methods such as decomposition of polyisobutylene having a high molecular weight and mixing of low-molecular polyisobutylenes.

Component B of the present invention, e.g., polyisobutylene, exhibits a traction coefficient of 0.075 to 0.085. Therefore, component B can be used alone in conventional power transmissions without posing any problem.

However, it is projected that a traction coefficient of 0.1 or more will be required in future traction drive devices. The use of component B alone in such future devices cannot satisfy this projected target. In such a case it is necessary to use a synthetic lubricating fluid prepared by blending the above-mentioned ester, i.e., component A, with the poly-α-olefin, i.e., component B.

It has been found that a blend of the ester of the instant invention with 1 to 70% by weight, particularly preferably 10 to 50% by weight, of the poly-α-olefin of the instant invention exhibits an unexpectedly high traction coefficient.

The synthetic lubricating fluid of the present invention can be used in power transmissions of internal combustion engines of automobiles and tractors, and general industrial machinery such as textile machines and food processing machines. When the transmission is a traction drive device the synthetic lubricating fluid of the present invention exhibits a remarkably enhanced performance.

Various additives may be added to the synthetic lubricating fluid of the present invention. Specifically, the addition of small amounts of a viscosity index improver, antioxidant and anticorrosive contributes to stabilization of the synthetic lubricating fluid of the present invention over long periods of time in power transmissions.

However, when a polymer which does not contain a quaternary carbon atom of the gem-dimethyl type in its main chain, such as polymethacrylate, is used as the viscosity index improver the traction coefficient is lowered. Therefore, if such a polymer is present, the amount of such polymer should be less than about 10% by weight The reason why the synthetic lubricating fluid of the present invention exhibits a traction coefficient much higher than that of the conventional fluids is not yet fully understood. However, basically the reason is believed to reside in the unique molecular structure of both of the components, i.e., components A and B.

Specifically, the ester component A has two cyclohexyl rings in its molecule linked through a carbonyl group. This brings about an interdipolar force between the molecules. It is believed that the interdipolar force serves to bring the fluid into a stable glassy state under high-load conditions, thereby increasing the shearing force. On the other hand, the poly-α-olefin, component B, is a nonpolar hydrocarbon. Therefore, in a fluid, the force between the molecules is mainly a van der Waals force. However, component B has an appropriate molecular weight and viscosity and possesses a number of branchings including a gem-dimethyl quaternary carbon, which suppresses the intramolecular rotation necessary for fluidization, thereby resulting in high traction coefficient. Further, it is believed that when the components A and B are blended together very high traction coefficient can be attained under high-load conditions. This is due to the fact that, component A, having a cyclohexyl ring is firmly, engaged, like gears, with component B having a gem-dimethyl quaternary carbon.

The following Examples are provided for illustrative purposes only and are not to be construed as limiting the invention herein described.

EXAMPLES 1-2

Component A (an ester compound of cyclohexanol with cyclohexanecarboxylic acid) of the present invention was synthesized by the following method.

513 g (4 mol) of cyclohexanecarboxylic acid, 800 g (8 mol) of cyclohexanol, and 10 g of phosphoric acid (catalyst) were placed in a round-bottom flask. The contents of the flask were heated at 200° C. for 20 hr while nitrogen was blown into the flask. Water formed during the esterification was trapped so as not to return to the flask. The reaction was terminated when the amount of the water reached 4 mol (72 cc).

After termination of the reaction the reaction product was washed with an aqueous sodium hydroxide solution until it was alkaline, thereby removing the unreacted cyclohexanecarboxylic acid and phosphoric acid. Subsequently, the reaction product was washed with water until it was neutral to remove sodium hydroxide, followed by distillation under reduced pressure to remove the excess cyclohexanol, thereby obtaining component A, i.e., an ester compound of cyclohexanol with cyclohexanecarboxylic acid. The yield of the final product, i.e., component A, was about 80%.

Thereafter, component A thus synthesized (hereinafter referred to as "$A_1$") and a second component A (hereinafter referred to as "$A_2$" which has been synthesized in the same manner as mentioned above and has the above general formula in which $R_1$ is a methyl group and $R_2$ and $R_3$ are each a hydrogen atom) were each blended with polyisobutylene (component B), followed by measurement of the traction coefficient. The measuring equipment used was a Soda-type four roller traction testing machine. The test was conducted under the following conditions: a fluid temperature of 30° C.; a roller temperature of 30° C.; a mean Hertzian pressure of 1.2 GPa; a rolling velocity of 3.6 m/s; and a slipping ratio of 3.0%. Under the above-mentioned conditions all oils exhibit the maximum traction coefficient at a slipping ratio of about 3%. Therefore, the traction coefficient determined can be regarded as the maximum traction coefficient. The molecular weight and loadings of the polyisobutylene were varied, followed by measurement of the traction coefficient. The results are shown in Table 1.

As can be seen from the results thus obtained a high traction coefficient is attained when component A is blended with 10 to 50% by weight of component B having a molecular weight of 900 to 5000.

COMPARATIVE EXAMPLES 1-7

Traction coefficients were measured in the same manner as described in the above examples with respect to the following comparative samples: component A by itself ($A_1$ or $A_2$); component B by itself; a hydrogenation product of α-methylstyrene linear dimer ("Santotrack" manufactured by the Monsanto Chemical Company); a blend of component $A_1$ with polymethacrylate (PMA); and a blend of component $A_1$ with an ethylene-propylene copolymer (OCP).

The results are shown in Table 1. As can be seen from Table 1 the traction coefficients of all the comparative examples were 95% or less of the traction coefficients of the synthetic lubricating fluid of the present invention.

TABLE 1

| | ester-polyisobutylene | | | | | | |
|---|---|---|---|---|---|---|---|
| | ester | average MW of B | loadings of B (wt %) | viscosity at 40° C. cSt | viscosity at 100° C. cSt | viscosity index | traction coefficient |
| Comp. Ex. 1 | | — | 0 | 6.38 | 1.92 | 74.6 | 0.092 |
| Ex. 1 | A1 | 900 | 25 | 19.3 | 4.5 | 153 | 0.102 |
| | | 900 | 34 | 29.7 | 6.3 | 170 | 0.103 |
| | | 900 | 43 | 51.7 | 9.0 | 155 | 0.107 |
| | | 900 | 52 | 132.5 | 13.7 | 99 | 0.101 |
| | | 1260 | 18 | 15.8 | 4.3 | 197 | 0.101 |
| | | 1260 | 26 | 28.4 | 6.0 | 165 | 0.102 |
| | | 1260 | 34 | 46.4 | 9.0 | 179 | 0.107 |
| | | 1260 | 42 | 115.7 | 14.1 | 122 | 0.103 |
| | | 2350 | 12 | 15.9 | 4.6 | 232 | 0.101 |
| | | 2350 | 19 | 30.1 | 7.3 | 223 | 0.103 |
| | | 2350 | 26 | 58.9 | 12.0 | 206 | 0.107 |
| | | 2350 | 33 | 147.0 | 20.0 | 157 | 0.106 |
| Comp. Ex. 2 | | — | 0 | 6.38 | 1.92 | 74.6 | 0.088 |
| Ex. 2 | A2 | 900 | 34 | 29.7 | 6.3 | 170 | 0.101 |
| | | 1260 | 26 | 28.4 | 6.0 | 165 | 0.102 |
| | | 2350 | 19 | 30.1 | 7.3 | 223 | 0.101 |
| Comp. Ex. 3 | — | 280 | 100 | 8.0 | 2.5 | 151 | 0.080 |

ester-OCP or PMA

TABLE 1-continued

| | ester | viscosity index improver | viscosity index improver (wt %) | viscosity at 40° C. cSt | viscosity at 100° C. cSt | viscosity index | traction coefficient |
|---|---|---|---|---|---|---|---|
| Comp. Ex. 4 | | OCP | 4 | 9.1 | 4.3 | 526 | 0.093 |
| | A1 | OCP | 10 | 27.0 | 11.7 | 455 | 0.091 |
| Comp. Ex. 5 | | PMA | 10 | 8.8 | 4.1 | 510 | 0.093 |
| | | PMA | 30 | 37.6 | 15.4 | 422 | 0.086 |

product of other company

| | product of other company | viscosity at 40° C. | viscosity at 100° C. | viscosity index | traction coefficient |
|---|---|---|---|---|---|
| Comp. Ex. 6 | "Santotrack" manufactured by the Monsant Chemical Company | 13.8 | 3.0 | 46 | 0.087 |
| Comp. Ex. 7 | high-viscosity commercially available traction base oil | 8.6 | 2.1 | 25 | 0.086 |
| | medium-viscosity commercially available traction base oil | 41.0 | 4.8 | −41 | 0.096 |
| | low-viscosity commercially available traction base oil | 69.6 | 5.9 | −66 | 0.090 |

The synthetic lubricating fluid of the present invention which comprises a blend of an ester compound of cyclohexanol with cyclohexanecarboxylic acid and 1 to 70% by weight of a branched poly-α-olefin having a molecular weight of 500 to 10,000, exhibits an extremely high traction coefficient. Therefore, the use of the synthetic lubricating oil of the present invention in a power transmission, particularly a traction drive device, results in a remarkable increase in shearing force under a high load. This allows a reduction in size of power transmissions as a well as efficient operation of the transmissions.

What is claimed is:

1. A synthetic lubricating fluid comprising:

(i) ester or its derivative of cyclohexanol and cyclohexanecarboxylic acid represented by the formula

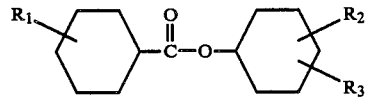

wherein $R_1$, $R_2$ and $R_3$ are independently selected from hydrogen and alkyl groups containing from 1 to 8 carbon atoms; and (ii) from 10 to 50% by weight of branched poly-α-olefin-selected from the group consisting of branched poly-α-olefins having an average molecular weight of 900 to 5,000.

2. The fluid of claim 1 wherein said poly-α-olefin is polyisobutylene.

3. The fluid of claim 1 wherein said fluid is a traction drive fluid.

* * * * *